US008095023B2

(12) United States Patent
Hwang

(10) Patent No.: US 8,095,023 B2
(45) Date of Patent: Jan. 10, 2012

(54) IMAGE FORMING APPARATUS

(75) Inventor: Jong In Hwang, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 979 days.

(21) Appl. No.: 12/021,596

(22) Filed: Jan. 29, 2008

(65) Prior Publication Data

US 2008/0187333 A1 Aug. 7, 2008

(30) Foreign Application Priority Data

Feb. 1, 2007 (KR) ..... 10-2007-0010666

(51) Int. Cl.
*G03G 15/20* (2006.01)

(52) U.S. Cl. ..... 399/33; 399/69

(58) Field of Classification Search ..... 399/33, 399/69

See application file for complete search history.

(56) References Cited

U.S. PATENT DOCUMENTS 5,754,917 A * 5/1998 Fromm et al. ..... 399/33
2005/0220467 A1* 10/2005 Takahashi et al. ..... 399/45

FOREIGN PATENT DOCUMENTS

CN 1677273 10/2005
KR 2005-117439 12/2005

OTHER PUBLICATIONS

Chinese Office Action issued Jun. 5, 2009 in CN Application No. 200810008932.5.

* cited by examiner

*Primary Examiner* — David Gray
*Assistant Examiner* — Erika J Villaluna
(74) *Attorney, Agent, or Firm* — Stanzione & Kim, LLP

(57) ABSTRACT

An image forming apparatus having a heating roller and a pressing roller includes a temperature sensing unit provided to be broken when the heating roller is overheated and a pressure releasing control unit provided to release the pressing roller from the heating roller when the temperature sensing unit is broken, when a microcomputer erroneously operates due to a damage of an A/D port of the microcomputer, such that the pressing roller is forcibly released from the heating roller by the pressure releasing control unit, thereby preventing the heating roller and the pressing roller from being fused to each other.

15 Claims, 6 Drawing Sheets

IMAGE FORMING APPARATUS

CROSS-REFERENCE TO RELATED APPLICATIONS

This application claims the benefit of Korean Patent Application No. 2007-10666, filed on Feb. 1, 2007, in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly to an image forming apparatus including a fixing unit having a heating roller and a pressing roller to fix a toner image transferred to a sheet, in which the pressing roller is released from the heating roller when the heating roller is overheated to prevent the heating roller and the pressing roller from being fused to each other.

2. Description of the Related Art

In general, as an example of an image forming apparatus, an electro-photographic image forming apparatus includes a charging unit, a laser scanning unit as an exposing unit, a developing unit, a transferring unit, and a fixing unit around a photoconductive drum. The surface of the photoconductive drum charged by the charging unit is exposed by the laser scanning unit to form an electrostatic latent image. The developing unit develops the electrostatic latent image to a toner image and the toner image is transferred to a sheet by the transferring unit. The toner image transferred to the sheet is fixed by the fixing unit to be transmitted to the outside.

In the above-described image forming apparatus, the transferred toner image is fixed by simultaneously applying heat and pressure to a sheet.

As illustrated in FIG. 1, the fixing unit includes a heating roller 10 rotatably provided to fuse a toner image 41 to a sheet 40 by heat, a pressing roller 20 rotatably provided to face the heating roller 10 and pressing the sheet 40 toward the heating roller 10, and pressing units 30 and 31 supporting the rotating shaft 21 of the pressing roller 20 so that the pressing roller 20 can press the sheet 40 to generate pressure.

A heat lamp 11 is provided in a center of the heating roller 10 so that the heating roller 10 is heated by radiant heat from the heat lamp 11. A thermistor 50 making contact with an outer peripheral portion of the heating roller 10 so as to sense a surface temperature of the heating roller 10 and a thermostat 60 shutting off a power being supplied to the heat lamp 11 when the temperature of the heating roller 10 is higher than a critical temperature are provided on one side of the heating roller 10. The thermistor 50 senses the surface temperature of the heating roller 10 to transmit the sensed temperature to a microcomputer of the image forming apparatus. The microcomputer controls the power supplied to the heat lamp 11 in accordance with the sensed surface temperature of the heating roller 10 to maintain the surface temperature of the heating roller 10 to be in a required uniform range. Also, an internal terminal of the thermostat 60 is opened when the temperature of the heating roller 10 is higher than the critical temperature to intercept the power source supplied to the heat lamp 11.

In general, in the image forming apparatus, when the heat lamp 11 continuously generates heat to overheat the heating roller 10, the pressing roller 20 is melted due to a high temperature so that the pressing roller 20 is fusion-welded to the heating roller 10.

Therefore, a conventional pressure releasing apparatus is provided in order to release the pressing roller 20 from the heating roller 10. The microcomputer of the image forming apparatus senses the temperature of the heating roller 10 by the thermistor 50 and, when it is determined that the heating roller 10 is overheated, and operates the pressure releasing apparatus to release the pressure of the pressing roller by the pressing unit 30 and 31 and to prevent the heating roller 10 and the pressing roller 20 from being fused to each other. However, the pressing roller 20 cannot be released and separated from the heating roller 10 enough to have a gap between the pressing roller 20 and the heating roller 10 or a recording medium disposed between the pressing roller 20 and the heating roller 10.

In general, the microcomputer of the image forming apparatus analog-to-digital (A/D) converts the voltage value sensed by the thermistor 50 by an A/D port to sense a temperature value. However, the A/D port of the microcomputer may be damaged by the static electricity of the sheet 40 or the surge voltage of a power source line. In such a case, the microcomputer erroneously operates.

When the heating roller 20 is continuously heated in a state in which the pressing roller 20 is not released because the pressure releasing apparatus does not operate due to the malfunction of the microcomputer, the heating roller 10 and the pressing roller 20 are fusion-welded welded to each other to break the thermostat 60.

SUMMARY OF THE INVENTION

The present general inventive concept provides an image forming apparatus in which a pressing roller is released when a heating roller is overheated regardless of whether a microcomputer normally operates or not to prevent the heating roller and the pressing roller from being fused to each other.

Additional aspects and utilities of the present general inventive concept will be set forth in part in the description which follows and, in part, will be obvious from the description, or may be learned by practice of the general inventive concept.

The foregoing and other aspects and utilities of the present general inventive concept may be achieved by providing an image forming apparatus including a fixing unit having a heating roller and a pressing roller pressed against the heating roller, the image forming apparatus comprising a pressure releasing unit that releases the pressing roller from the heating roller, a temperature sensing unit which is broken when the heating roller is overheated, and a pressure releasing controller to control the pressure releasing unit to release the pressing roller from the heating roller when the temperature sensing unit is broken.

The foregoing and other aspects and utilities of the present general inventive concept may also be achieved by providing an image forming apparatus including a fixing unit having a heating roller and a pressing roller pressed against the heating roller, the image forming apparatus comprising a pressure releasing unit that releases the pressing roller from the heating roller, a first temperature sensing unit provided to sense the temperature of the heating roller, a second temperature sensing unit provided to be broken when the heating roller is overheated, a first pressure releasing controller to control an operation of the pressure releasing unit to read a temperature of the heating roller by the first temperature sensing unit and to release the pressing roller when the heating roller is overheated, and a second pressure releasing controller to control the operation of the pressure releasing unit to release the pressing roller when the second temperature sensing unit is broken.

The foregoing and other aspects and utilities of the present general inventive concept may also be achieved by providing an image forming apparatus having a heating roller and a pressing roller, the image forming apparatus including a temperature sensing unit to detect a temperature of the heating roller, and a pressure releasing unit to selectively move the pressing unit with respect to the heating roller according to the detected temperature and a state of the temperature sensing unit.

The foregoing and other aspects and utilities of the present general inventive concept may also be achieved by providing a method of an image forming apparatus having a heating roller and a pressing roller, the method including detecting a temperature of the heating roller using a temperature sensing unit, and selectively moving the pressing unit with respect to the heating roller according to the detected temperature and a state of the temperature sensing unit.

BRIEF DESCRIPTION OF THE DRAWINGS

These and/or other aspects and utilities of the present general inventive concept will be more apparent from the following detailed description taken in conjunction with the accompanying drawings, in which.

DETAILED DESCRIPTION OF THE PREFERRED EMBODIMENTS

Figure 1:
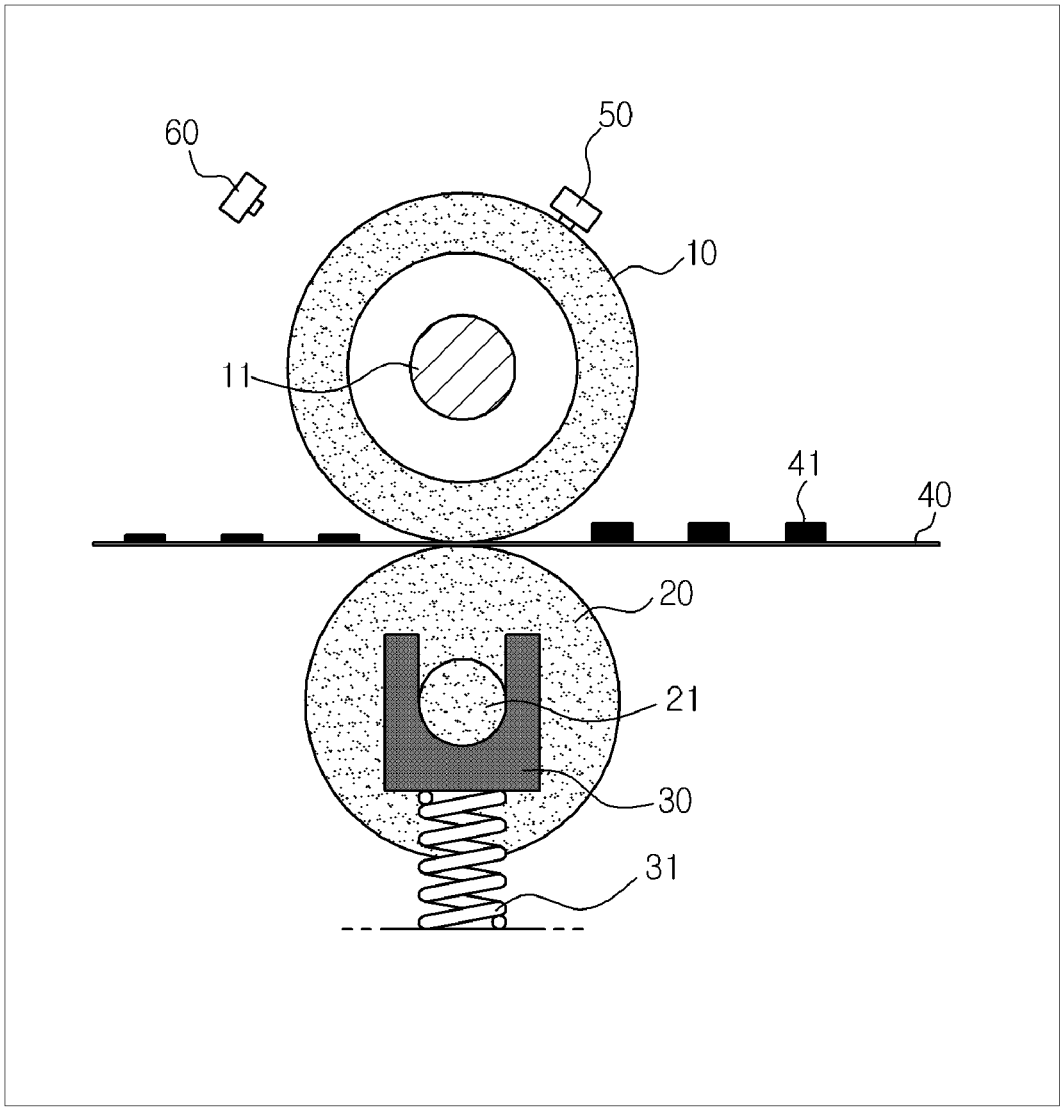
FIG. 1 is a view illustrating a fixing unit of a conventional image forming apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
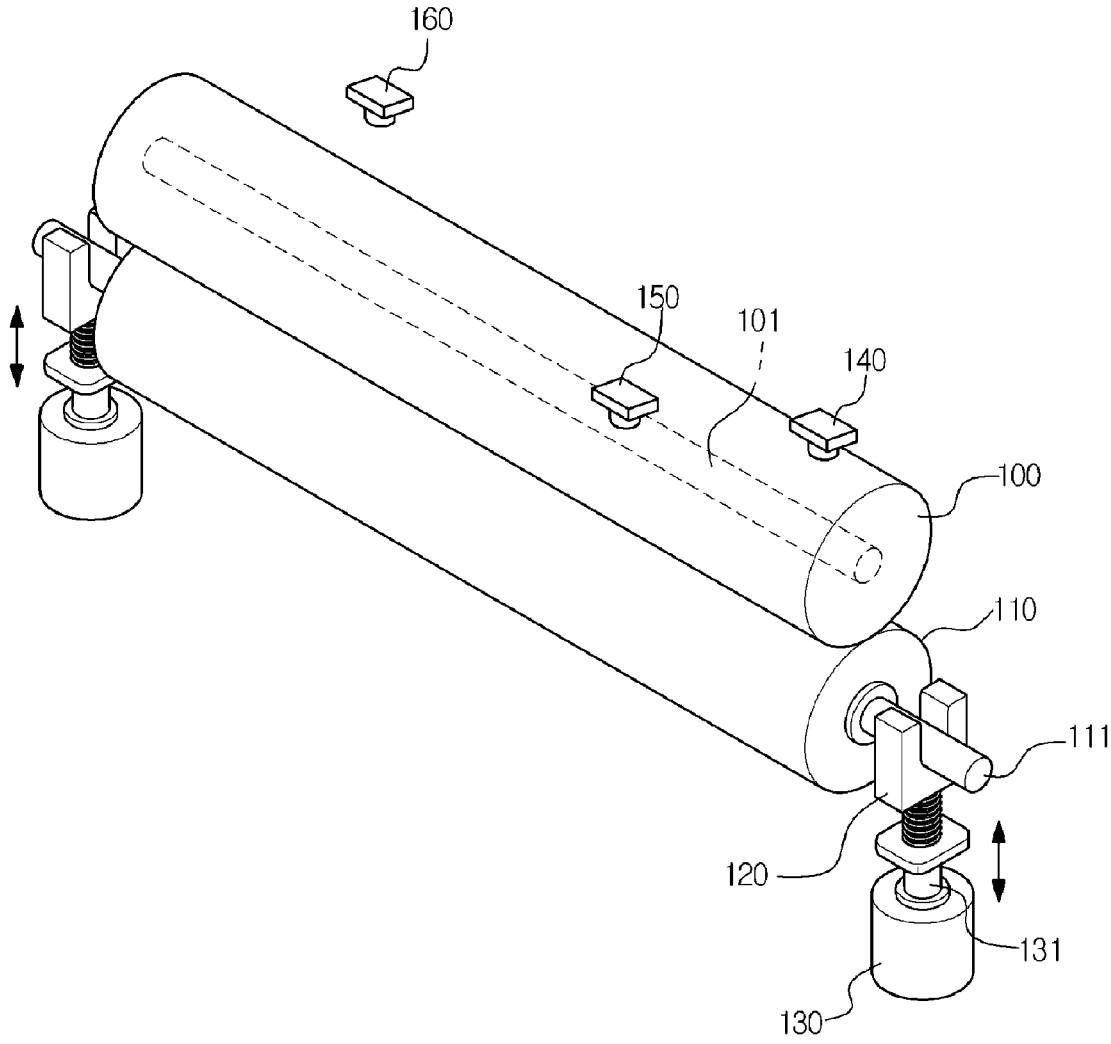
FIG. 2 is a perspective view illustrating a fixing system of an image forming apparatus according to an embodiment of the present general inventive concept.

FIG. 2 is a perspective view illustrating a fixing system of an image forming apparatus according to an embodiment of the present general inventive concept. Referring to FIG. 2, the fixing unit of the image forming apparatus according to the present invention includes a heating roller 100, a pressing roller 110, a pressing unit, a pressure releasing unit 130, a first temperature sensing unit 140, a second temperature sensing unit 150, and a third temperature sensing unit 160.

The heating roller 100 is rotatably provided to fuse a toner to a sheet by heat. A heat lamp 101 is provided in the center of the heating roller 100 so that the heating roller 100 is heated by radiant heat from the heat lamp 101.

The pressing roller 110 is rotatably provided to face the heating roller 100 and presses a sheet toward the heating roller 100. The pressing roller 110 is formed of rubber to smoothly press the sheet and includes a rotating shaft 111 making the pressing roller 110 rotatable therein.

The pressing unit supports the rotating shaft 111 of the pressing roller 110 so that the pressing roller 110 can press the sheet to generate pressure. The pressing unit includes a U-shaped supporting guide 120 to support both ends of the rotating shaft 111 of the pressing roller 110 and a pressing spring 121 one side of which is coupled with the supporting guide 120 and the other side of which is coupled with the pressure releasing unit 130 to elastically support the supporting guide 120 and to generate pressure of a uniform magnitude toward the pressing roller 110.

Figure 3:
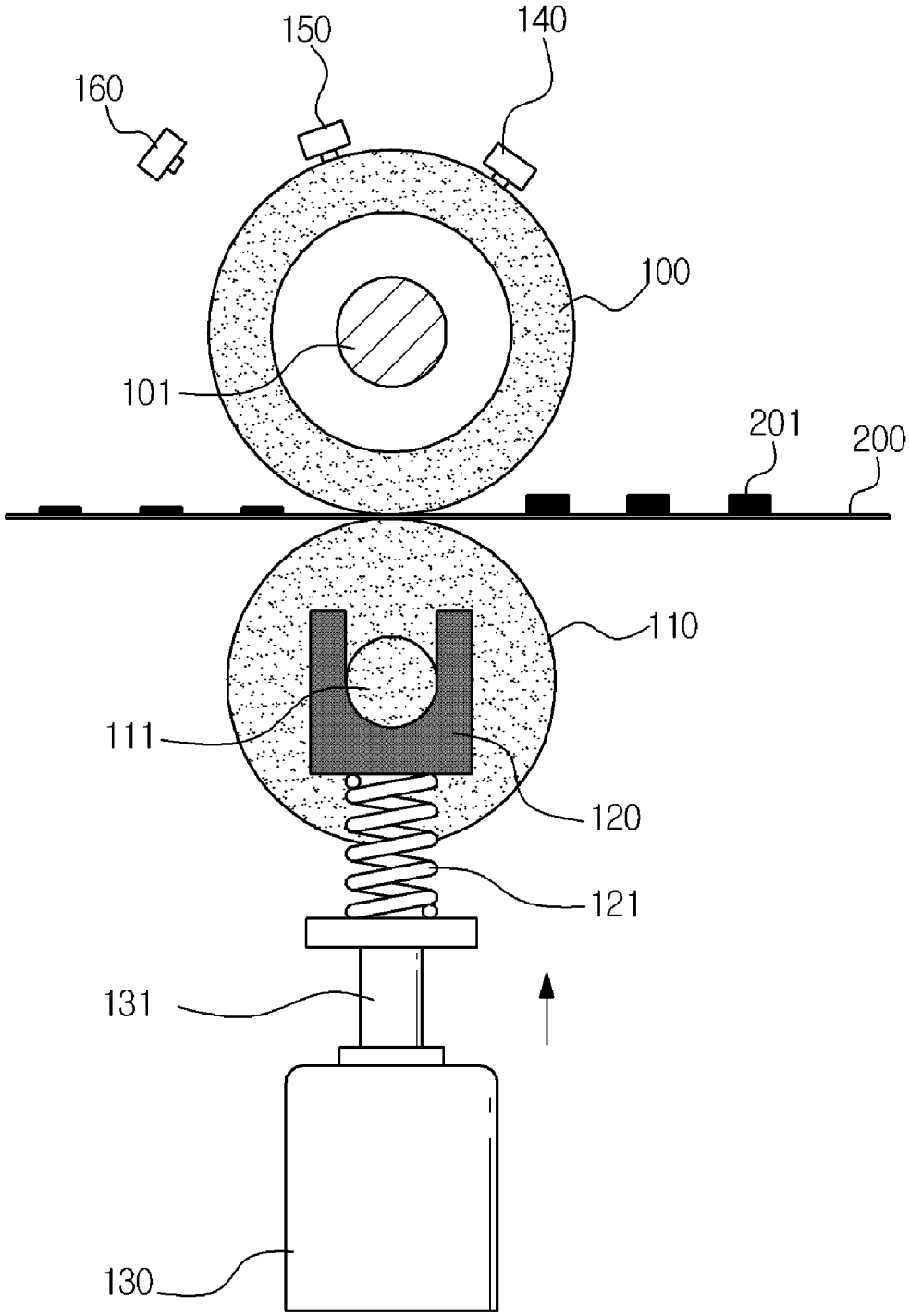
FIG. 3 is a view illustrating a pressing roller pressed against a heating roller shown in FIG. 2.
Figure 4:
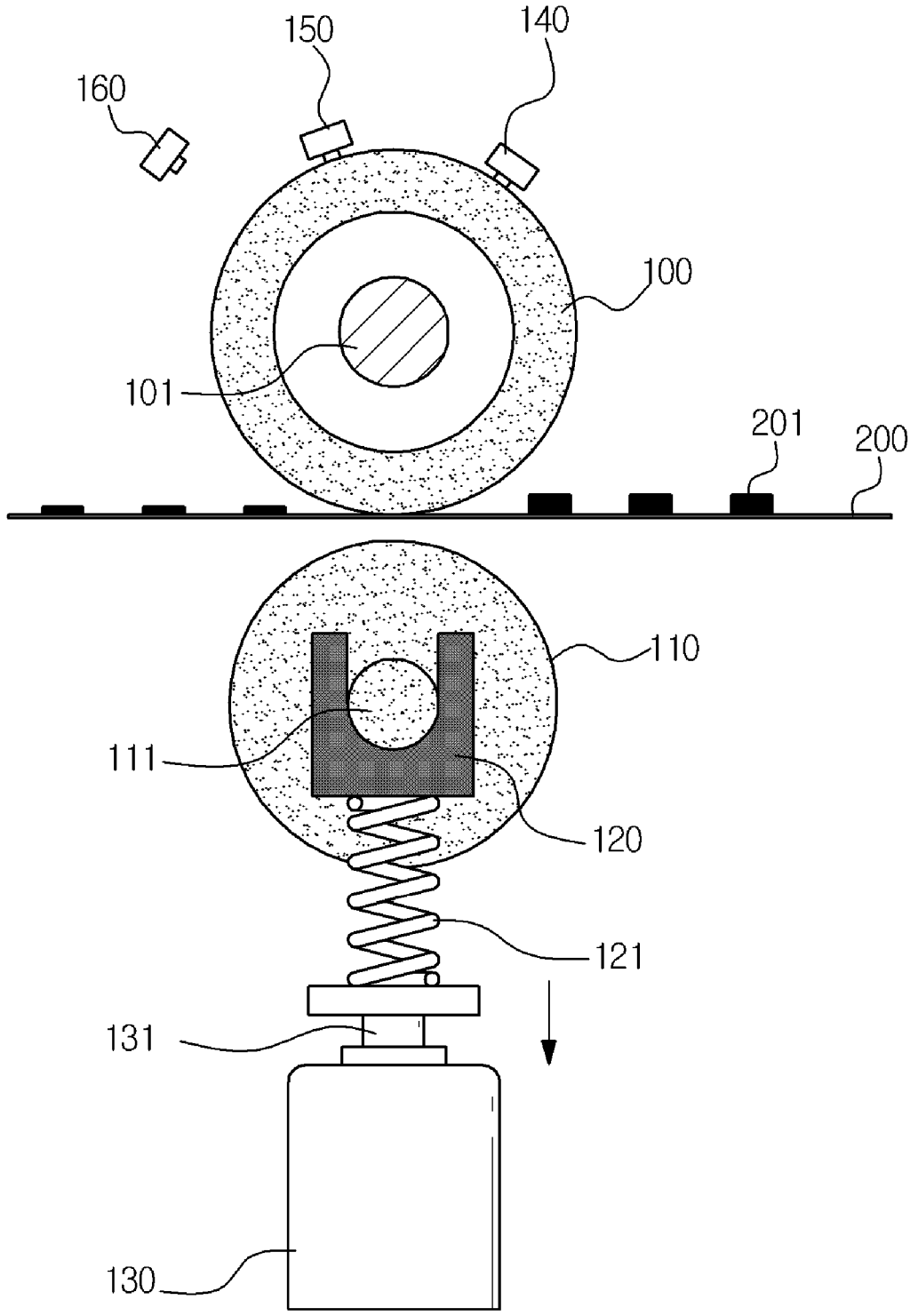
FIG. 4 is a view illustrating a pressing roller released from the heating roller in FIG. 2.

The pressure releasing unit 130 includes a solenoid valve that can move up and down a plunger 131 by an electrical signal therein and that includes an end portion coupled to the other side of the pressing spring 121. When the solenoid valve is turned off, the plunger 131 supports the pressing spring 121 on the pressing spring 121 so that pressure of a uniform magnitude is generated by the pressing spring 121. When the solenoid valve is turned on, the plunger 131 falls down so that the pressure generated by the pressing spring 121 is released. Therefore, as illustrated in FIGS. 3 and 4, the pressing roller 110 is pressed against the heating roller 100 when the solenoid valve is turned off and the pressing roller 110 is released from the heating roller 100 when the solenoid valve is turned on. FIG. 4 shows a gap between the pressing roller 110 and the heating roller 100 or a recording medium disposed between the pressing roller 110 and the heating roller 100.

The first temperature sensing unit 140 includes a first thermistor provided to contact an external circumference of the heating roller 100 and to sense a temperature of a surface of the heating roller 100.

The second temperature sensing unit 150 includes a second thermistor provided on one side of the heating roller 100 to be broken (i.e., in a malfunction or open state) when the heating roller 100 is overheated. An internal terminal of the second thermistor is opened when the temperature of the heating roller 100 is higher than a predetermined overheating temperature.

The third temperature sensing unit 160 includes a thermostat provided to intercept a power source to the heat lamp 101 when the temperature of the heating roller 100 is higher than a predetermined critical temperature. The internal terminal of the thermostat is opened to intercept the power source supplied to the heat lamp 101 when the temperature of the heating roller 100 is higher than the predetermined critical temperature.

Figure 5:
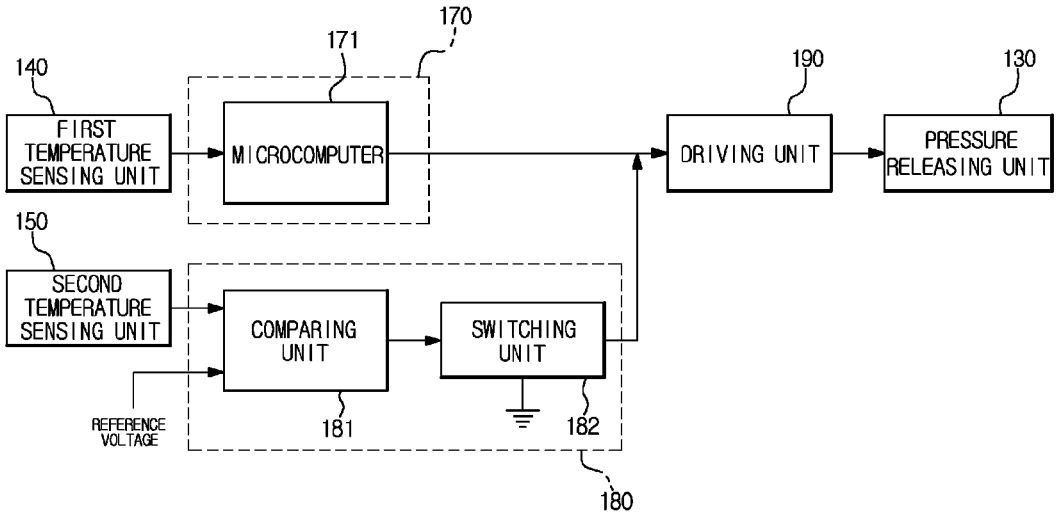
FIG. 5 is a block diagram of a fixing system of the image forming apparatus according to an embodiment of the present general inventive concept.

FIG. 5 is a block diagram of a fixing system of an image forming apparatus according to an embodiment of the present general inventive concept. Referring to FIGS. 3-5, the fixing system of the image forming apparatus according to the present general inventive concept includes a driving unit 190 to drive the pressure releasing unit 130 to release releases the pressing roller 110 from the heating roller 100, a first pressure releasing controller 170 to control an operation of the pressure releasing unit 130 by the driving unit 190 to read a temperature value of the heating roller 100 by the first temperature sensing unit 140 and to release the pressing roller 110 when the heating roller 100 is overheated, and a second pressure releasing controller 180 to control the operation of the pressing unit by the driving unit 190 to release the pressing roller 110 when the second temperature sensing unit 150 is broken.

The driving unit 190 supplies a power source to the pressure releasing unit 130 or intercepts the power source from the pressure releasing unit 130 by a signal output from the first pressure releasing controller 170 or the second pressure releasing controller 180 to turn on or off the pressure releasing unit 130.

The first pressure releasing controller 170 includes a microcomputer 171. The microcomputer 171 reads the voltage sensed by the first temperature sensing unit 140 by an analog-to-digital (A/D) port and compares the temperature corresponding to the read voltage value with the predetermined overheating temperature to turn on the pressure releasing unit 130 by the driving unit 190 and to release the pressing roller 110 from the heating roller 100 when it is determined that the temperature corresponding to the read voltage value is higher than the predetermined overheating temperature. Also, temperature of the heating roller 100 can be controlled by controlling (or turning on and off) of the heat lamp 101 or controlling an electrical power supplied to the heat lamp 101 according to the temperature corresponding to the sensed voltage.

The second pressure releasing controller 180 includes a comparing unit 181 and a switching unit 182. The comparing unit 181 changes an output signal value by a change in a voltage generated when the second temperature sensing unit 150 is broken to turn on or off the switching unit 182. When the switching unit 182 is turned on or off, the driving unit 190 operates to turn on or off the pressure releasing unit 130.

Figure 6:
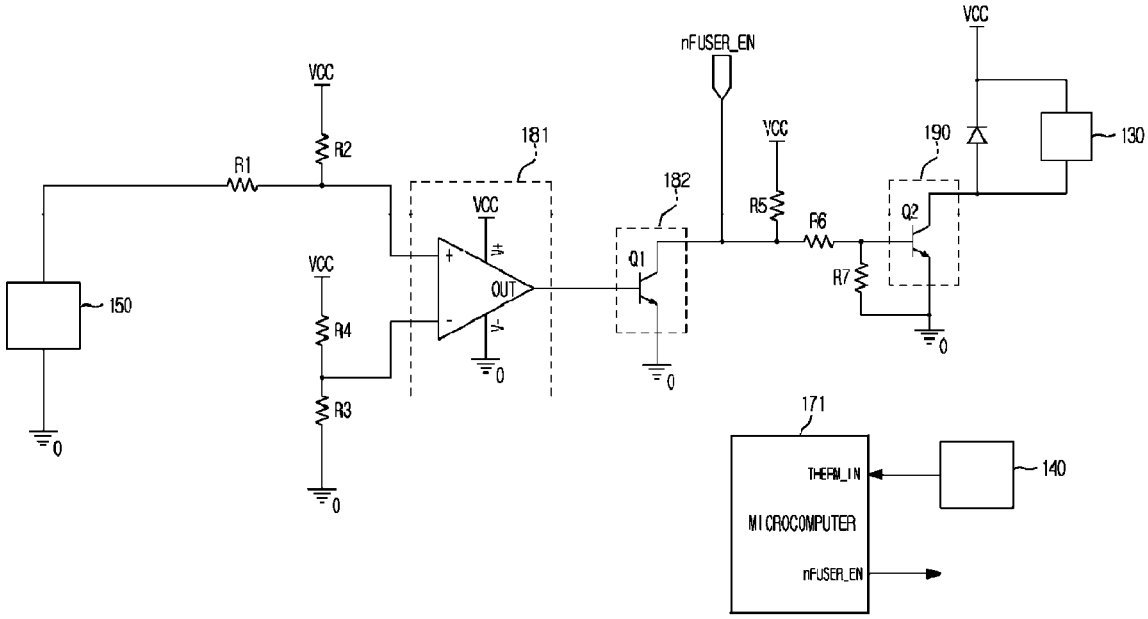
FIG. 6 is a view illustrating a control circuit controlling the operation of the pressure releasing unit of FIG. 5.

The above components will be described in detail with reference to FIG. 6. First, the first temperature sensing unit 140 and the second temperature sensing unit 150 may be negative temperature coefficient (NTC) thermistors in which a temperature and a resistance value are in inverse proportion to each other output a lower voltage value at a higher temperature.

The voltage sensed by the first temperature sensing unit 140 sensing the temperature of the surface of the heating roller 100 is input to an A/D port THERM_IN of the microcomputer 171.

Also, one side of the second temperature sensing unit 150 provided to be broken when the heating roller 100 is overheated so that the internal terminal thereof is opened when the temperature of the heating roller 100 is higher than the predetermined overheating temperature is connected to a "+" stage (terminal) of the comparing unit 181 and the other side of the second temperature sensing unit 150 is grounded. Therefore, the voltage sensed by the second temperature sensing unit 150 is caught in the "+" stage that is a non-inversion terminal of the comparing unit 181 and a reference voltage divided by a resistor R3 and a resistor R4 is caught in a "−" stage (terminal) that is an inversion terminal of the comparing unit 181.

The comparing unit 181 compares the voltage sensed by the second temperature sensing unit 150 that is caught in the "+" stage with the reference voltage caught in the "−" stage to output a first output value at a high level when it is determined that the sensed voltage is higher than the reference voltage and to output a second output value at a low level when the sensed voltage is no more than the reference voltage.

The switching unit 182 including a transistor Q1 is electrically connected to an output side of the comparing unit 181. A base stage (terminal) of the transistor Q1 is connected to the output side of the comparing unit 181. An emitter stage (terminal) of the transistor Q1 is grounded. A collector stage (terminal) of the transistor Q1 is connected to the output port nFUSER_EN of the microcomputer 171 and the driving unit 190. Therefore, the switching unit 182 is turned on when the output of the comparing unit 181 is at a high level and is turned off when the output of the comparing unit 181 is at a low level.

The driving unit 190 including a transistor Q2 is turned on to turn on the pressure releasing unit 130 when a gate stage is at a high level and is turned off to turn off the pressure releasing unit 130 when the gate stage is at a low level.

The operation of the control circuit will be described. First, the microcomputer 171 outputs a signal at a low level through the output port nFUSER_EN to turn off the driving unit 190 when the temperature corresponding to the voltage read from the first temperature sensing unit 140 is less than the predetermined overheating temperature. Therefore, since the pressure releasing unit 130 does not operate so that the pressure generated by the pressing spring 121 maintains a uniform magnitude, the pressing roller 110 is maintained to be pressed against the heating roller 100. At this time, since the voltage sensed by the second temperature sensing unit 150 that is caught in the "+" stage of the comparing unit 181 is higher than the reference voltage caught in the "−" stage, a signal at a high level is output. The switching unit 182 is turned on by the signal at the high level so that the control performed by the microcomputer 171 is not affected. That is, even if there is a defect or damage on a connection between the first temperature sensing unit 140 and the microcomputer 171 or the driving unit 190, the pressure releasing unit can be controlled by the driving unit to release the pressing roller 110 from the heating roller 100 according to information on a state of the second temperature sending unit 140. The controlling of the driving unit 190 by the microcomputer 171 may include controlling a heating operation to maintain a desired temperature to fix a toner image 201 on the recording medium 200 by turning on and off the heating lamp 101 or controlling a voltage supplied to the heat lamp 101.

On the other hand, the microcomputer 171 outputs a signal at a high level through the output port nFUSER_EN to turn on the driving unit 190 when the temperature corresponding to the voltage read from the first temperature sensing unit 140 is no less than the predetermined overheating temperature. Therefore, the pressure releasing unit 130 operates so that the pressing roller 110 is released from the heating roller 100.

At this time, as described above, the A/D port of the microcomputer 171 is damaged by static electricity of a sheet or a surge voltage of a power line. Therefore, the microcomputer 171 may not turn on the driving unit 190 although the microcomputer 171 is supposed to turn on the driving unit 190 to operate the pressure releasing unit 130. In such a case, the pressing roller 110 and the heating roller 100 are fusion-welded to each other. When the A/D port of the microcomputer 171 is maintained to be damaged, the thermostat is broken.

However, according to the present embodiment, although the microcomputer 171 erroneously operates, since the second temperature sensing unit 150 is broken due to the overheat of the heating roller 100, the output value of the comparing unit 181 is transited from high to low to turn off the switching unit 182. Therefore, since the driving unit 190 is turned on to operate the pressure releasing unit 130, the pressing roller 110 can be forcibly released from the heating roller 100. Therefore, even if the microcomputer 171 erroneously operates, the pressing roller 110 and the heating roller 100 can be prevented from being fused to each other.

As described above, according to the present embodiment, the image forming apparatus, in which the heating roller and the pressing roller are provided to be released from each other, includes the temperature sensing unit which is broken when the heating roller is overheated and the pressure releasing control unit provided to release the pressing roller from the heating roller when the temperature sensing unit is broken. Thus, in a case in which the pressing roller is not released from the heating roller due to a malfunction of the microcomputer caused by a defect of the A/D port of the microcomputer, the pressing roller is forcibly released from the heating roller by means of the pressure releasing control unit, preventing the heating roller and the pressing roller from being fused to each other.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus comprising a fixing unit having a heating roller and a pressing roller pressed against the heating roller, the image forming apparatus comprising:

a pressure releasing unit that releases the pressing roller from the heating roller;

a first temperature sensing unit provided to sense a temperature of the heating roller;

a second temperature sensing unit which is broken when the heating roller is overheated;

a first pressure releasing controller to control an operation of the pressure releasing unit to read a temperature of the heating roller by the first temperature sensing unit and to release the pressing roller when the heating roller is overheated; and a second pressure releasing controller to control the operation of the pressure releasing unit to release the pressing roller when the second temperature sensing unit is broken.

2. The image forming apparatus as claimed in claim 1, wherein the first temperature sensing unit and the second temperature sensing unit comprise thermistors provided to sense the temperature of the heating roller.

3. The image forming apparatus as claimed in claim 1, wherein the first pressure releasing controller comprises a microcomputer having an A/D port reading a voltage sensed by the first temperature sensing unit.

4. The image forming apparatus as claimed in claim 1, wherein the second pressure releasing controller comprises:

a comparing unit to compare the voltage sensed by the second temperature sensing unit with a predetermined reference voltage to output a first signal when the voltage sensed by the second temperature sensing unit is no more than the predetermined reference voltage and to output a second signal when the voltage sensed by the second temperature sensing unit is higher than the predetermined reference voltage; and a switching unit turned off by the first signal output from the comparing unit to turn on the pressure releasing unit.

5. The image forming apparatus as claimed in claim 1, wherein the pressure releasing unit comprises a solenoid valve provided to release the pressure of a pressing unit generating pressure to press the pressing roller to the heating roller.

6. An image forming apparatus having a heating roller and a pressing roller, comprising:

a temperature sensing unit to detect a temperature of the heating roller;

a pressure releasing unit to selectively move the pressing roller with respect to the heating roller according to the detected temperature and a state of the temperature sensing unit;

a microcomputer to receive the temperature and to generate a first signal to control the pressure releasing unit according to the temperature; and a comparing unit to generate a second signal to control the pressure relating unit according to the state of the temperature sensing unit.

7. The image forming apparatus as claimed in claim 6, wherein the state of the temperature sensing unit comprises a broken state or a malfunction state of the temperature sensing unit.

8. The image forming apparatus as claimed in claim 6, wherein the state of the temperature sensing unit comprises a state where the temperature sensing unit is broken due to overheating of the heating roller.

9. The image forming apparatus as claimed in claim 6, wherein the state of the temperature sensing unit comprises a state where the pressure releasing unit does not receive the temperature of the heating roller from the temperature sensing unit.

10. The image forming apparatus as claimed in claim 6, wherein the pressure releasing unit comprises:

a motor unit;

a plunger connected to the motor unit to move according to an operation of the motor unit; and an elastic member disposed between the pressing roller and the, plunger to elastically bias the pressing roller toward the heating roller with respect to the plunger.

11. The image forming apparatus as claimed in claim 6, wherein the state of the temperature sensing unit is generated according to a first connection between the microcomputer and the temperature sensing unit and a second connection between the microcomputer and the pressure releasing unit.

12. The image forming apparatus as claimed in claim 6, further comprising:

a switching unit to give a higher priority to the state of the temperature sensing unit than the temperature of the heating roller.

13. The image forming apparatus as claimed in claim 6, wherein the state of the temperature sensing unit has a higher priority than the temperature to control the pressure releasing unit.

14. The image forming apparatus as claimed in claim 6, wherein the pressure releasing unit controls the pressing roller to form a gap with the heating roller or a recording medium to be disposed therebetween according to the state of the temperature sensing unit when there is no detected temperature of the heating roller from the temperature sensing unit.

15. The image forming apparatus as claimed in claim 6, wherein the temperature sensing unit comprises:

a first temperature sensing unit to detect the temperature of the heating roller; and a second temperature sensing unit spaced-apart from the first temperature sensing unit to detect the temperature of the heating roller and to generate the state of the temperature sensing unit.

* * * * *